US005905438A

United States Patent [19]

Weiss et al.

[11] Patent Number: 5,905,438

[45] Date of Patent: May 18, 1999

[54] REMOTE DETECTING SYSTEM AND METHOD

[75] Inventors: John Weiss, Mount Sinai; Gerald T. Bodner, Manhasset, both of N.Y.

[73] Assignee: Micro Weiss Electronics, West Babylon, N.Y.

[21] Appl. No.: 08/781,668

[22] Filed: Jan. 10, 1997

[51] Int. Cl.[6] ..... G08B 21/00

[52] U.S. Cl. ..... 340/636; 340/539

[58] Field of Search ..... 340/531, 534, 340/539, 630, 636, 693, 527, 693.1, 693.2; 307/10.7

[56] References Cited

U.S. PATENT DOCUMENTS

| | | | |
|---|---|---|---|
| 3,877,001 | 4/1975 | Bogut et al. | 340/527 |
| 3,909,722 | 9/1975 | Bennett, Jr. | 340/539 |
| 4,160,246 | 7/1979 | Martin et al. | 340/630 |
| 4,191,948 | 3/1980 | Stockdale | 340/539 |
| 4,232,308 | 11/1980 | Lee et al. | 340/539 |
| 4,631,527 | 12/1986 | De Witt et al. | 340/539 |
| 4,812,827 | 3/1989 | Scripps | 340/693 |
| 5,019,803 | 5/1991 | Maram | 340/693 |
| 5,257,007 | 10/1993 | Steil et al. | 340/539 |
| 5,438,607 | 8/1995 | Przygoda et al. | 379/38 |
| 5,686,896 | 11/1997 | Bergman | 340/636 |

*Primary Examiner*—Jeffery A. Hofsass
*Assistant Examiner*—Van T. Trieu
*Attorney, Agent, or Firm*—Hoffmann & Baron, LLP

[57] ABSTRACT

A system for detecting the existence of a hazardous condition in an area includes a number of battery-powered detecting units whereby each detecting unit is respectively located within a zone within the area and each detecting unit includes a sensing circuit, a battery level monitoring circuit and a transmitting circuit. The sensing circuit senses the existence of a hazardous condition within that respective zone and generates a hazardous condition alert signal in response thereto. The battery level monitoring circuit monitors the level of the battery powering the detecting unit and generates a battery status signal when the battery is at an acceptable level. The transmitting circuit transmits the hazardous condition alert signal and/or the battery status signal. The system also includes a receiving unit which is responsive to the detecting units and includes a receiving circuit, a battery status indicating circuit and a hazard condition alert circuit. The receiving circuit receives the hazardous condition alert signals and/or the battery status signals. The battery status indicating circuit is responsive to the battery status signals and includes a number of visual indicators, corresponding to the number of detecting units, which are respectively responsive to the battery status signals such that each indicator provides a first visual indication when the respective battery status signal corresponding thereto is received and a second visual indication when the respective battery status signal is not received. The hazardous condition alert circuit is responsive to the hazardous condition alert signals such that the alert circuit respectively activates the visual indicators corresponding to one of the detecting units when an alert signal is received therefrom. The battery status signals are preferably periodically transmitted by the detecting units to the receiving unit.

34 Claims, 13 Drawing Sheets

TO FIG. 6A

REMOTE DETECTING SYSTEM AND METHOD

BACKGROUND OF THE INVENTION

1. Field of the Invention

The present invention relates to remote detecting systems and methods, and more particularly relates to remote detecting systems and methods for detecting hazardous conditions and the like.

2. Description of the Prior Art

It is well know that many battery-operated smoke detectors (as well as other similar detectors for detecting hazardous conditions such as flames from a fire or gas build-ups and leaks, e.g., carbon monoxide) installed in homes and businesses are rendered inoperable due to weak or disconnected batteries. Despite local and state fire authorities encouraging periodic testing of the batteries, many detectors are unfortunately rendered inoperative simply because owners are either unfamiliar with or unwilling to perform the maintenance procedures developed by existing detector manufacturers to test the batteries.

For example, one such conventional maintenance procedure for testing a detector battery on a ceiling mounted detector encompasses reaching up, sometimes with the aid of a broomstick, and depressing a button that activates the alarm buzzer. The alarm buzzer, by design, produces a loud piercing shriek that can be quite unpleasant especially when the detector is within arm's length. Other conventional detectors have attempted to overcome the need to actively test a detector by developing a detector which provides an audible "chirp" to alert the user that the strength of the battery is getting low. However, this chirping is so annoying that many owners disconnect the battery once they hear the audible warning and attempt to remember to replace the battery when they get a chance. Even the most diligent owners who periodically test the battery will realize that the act of testing the battery will cause the batteries life to be shortened. Also, in detectors with an audible low battery's warning, it is known that the chirping will cause the battery to be short lived.

Further attempts to make testing detector batteries more convenient have included systems which employ remote controlled testing features. One conventional approach uses the light beam from a flashlight to activate the alarm and, thus, test the battery. In such detectors, it is also suggested to use the flashlight to silence an alarm that has been inadvertently set off, as by cooking or smoking. However, such approach assumes that an operable flashlight is always handy, which is usually not the case. Still further, it is also known that, in place of the light beam of a flashlight activating the battery test in a detector, a radio frequency (RF) signal from a handheld remote control unit, directed at the detector, can be transmitted to the detector to activate the test procedure. However, a detector which operates with the remotely transmitted RF signal must continuously be ready to receive the RF test signal at all times. Such a continuously operating receiver in the detector disadvantageously drains the detector battery.

Another limit on the reliability of battery operated smoke detectors is associated with the fact that a detector whose alarm has been set off by a hazardous condition in the room in which it is installed may not be heard by a person in a distant room, e.g., an alarm in the basement may not be heard by someone sleeping on the third floor. Even if a distant alarm is heard, it is not always discernible as to the location of the sound and the possible dangerous condition (e.g., smoke from a fire) and, as a result, valuable time is lost in roaming around until the location is discovered. By the time other evidence of the hazardous condition is noticed (e.g., flames from a fire), critical time for deciding an escape route has already been wasted.

OBJECTS AND SUMMARY OF THE INVENTION

It is an object of the present invention to provide remote detecting systems and methods which overcome the inherent disadvantages of battery-powered detectors which detect the existence of hazardous conditions such as smoke, flames, gases and the like.

It is another object of the present invention to provide remote detecting systems and methods which provide substantial improvement in the reliability of such detectors by utilizing a remote receiver to continuously indicate a battery status of a plurality of detecting units requiring only visual interaction by the user.

It is yet another object of the present invention to provide remote detecting systems and methods which includes a receiver/indicator unit that more directly alerts the user to a hazardous condition.

It is a further object of the invention to provide remote detecting systems and methods which include a receiver having a display that provides valuable information regarding the location of the hazardous condition enabling the user to quickly decide a course of action.

In accordance with one form of the present invention, a system for detecting the existence of a hazardous condition in an area includes at least one battery-powered detecting unit which is located within the area for detecting the existence of the hazardous condition. The battery-powered detecting unit generates and transmits a battery status signal in response to the battery being at an acceptable level. Further, the system includes at least one receiving unit which is responsive to the battery status signal such that the receiving unit provides at least one sensory indication when the battery status signal is not received. In this manner, the status of the battery is passively and continuously monitored thereby relieving an owner of the task of activating a test procedure himself.

In a preferred embodiment, the system includes a plurality of battery-powered detecting units (e.g., four) which are respectively located within a plurality of zones within an area (e.g., a residence or office building) such that each detecting unit generates and transmits its own battery status signal to the receiving unit. The receiving unit then responsively provides one of a plurality of sensory indications when one of the plurality of battery status signals is not respectively received. Still further, in a preferred form of the present invention, the receiving unit provides a first sensory indication when the battery status signal is received and a second sensory indication when the battery status signal is not received. The first sensory indication may be provided by a first indicator which, preferably, is a green light emitting diode. Similarly, the second sensory indication may be provided by a second indicator which, preferably, is a red light emitting diode. It is to be understood that, preferably, each detecting unit only periodically generates and transmits a battery status signal (e.g., every four hours). In this way, the transmitting circuit used to transmit the signal need only be active at the time the unit is transmitting a signal. Therefore, there is less of a drain on the battery as compared to conventional units which require constantly active components. Also, it is preferred that the receiving unit, which is preferably continuously powered via AC power from an AC outlet, only activate the visual indicators to indicate the absence of a battery status signal after a predetermined time period has elapsed (e.g., 12 hours) in which no signal has been received.

It is to be appreciated that the at least one sensory indication provided by the receiving unit may also provide an indication that the detecting unit has detected a hazardous condition. Such additional indication may be provided visually through the first and second indicators (e.g., flashing the LEDs), described above, or through an audible indicator (e.g., speaker or buzzer). Furthermore, even when the battery voltage in the detecting unit is below an acceptable level, it is to be appreciated that the transmitting circuit in the detecting unit is still able to transmit the hazardous condition alert signal to the receiving unit due to the preferably low power requirements associated with the transmitting circuit.

In a further preferred embodiment of the present invention, despite the fact that the battery voltage in the detecting unit is below the acceptable level, the detecting unit may generate and transmit a secondary status signal. The detecting unit is still able to generate and transmit the secondary status signal due to the low power requirements of the transmitting circuit. The secondary status signal is preferably generated a certain time (e.g., approximately two weeks) after the battery status signal is no longer transmitted and, once transmission begins, the secondary status signal is preferably retransmitted periodically (e.g., approximately every four hours). The receiving unit receives the secondary status signal and, in response, activates the audible indicator to provide a "chirp" warning sound. In this way, if a person fails to see that the receiving unit is giving a battery low visual indication, the receiving unit will provide an audible warning to the person to indicate that the battery needs replacement. It is to be appreciated that generation of the chirp is provided by the receiving unit which is preferably powered via an AC outlet and, therefore, does not put an additional drain on the detecting unit battery.

Both the battery-powered detecting unit and the receiving unit of the system of the present invention may include means for silencing the audible indicator (e.g., hush buttons) as well as the visual indicators activated during the detection of the existence of a hazardous condition.

In yet another form of the present invention, the receiving unit may include a lamp, (e.g., a nightlight) for illuminating an area in the vicinity of the receiving unit. Also, as previously mentioned, the receiving unit is preferably adapted to be powered via AC power provided by an AC power outlet. As an alternative, a rechargeable battery may be provided in the receiving unit as a source of power for the unit. In this manner, the receiving unit with the lamp, driven by the rechargeable battery, may be used as a portable light source (e.g., flashlight).

In accordance with a method for monitoring a voltage level associated with a battery of a battery-powered detecting unit, the method includes the steps of generating a battery status signal when the battery in the detecting unit is at an acceptable level and then transmitting the battery status signal from the detecting unit. The method further includes monitoring the battery status signal at a receiving unit, the receiving unit including a sensory indicator. Lastly, the method includes activating the sensory indicator when the battery status signal is not received by the receiving unit.

Accordingly, the present invention provides a system for remotely monitoring the status of a battery used to power a detecting unit mounted on a ceiling or wall within a residence or office building. The system of the present invention also provides for the ability to detect and monitor the existence of a hazardous condition in an area within the vicinity of the detecting unit and to be able to determine the precise location of the hazardous condition while remaining a safe distance from the hazardous condition. Such remote detecting and monitoring provides a person in a residence or building in which a hazardous condition exists with more time to plan an escape route from the residence or building.

Furthermore, the detector system of the present invention overcomes the inherent disadvantages of conventional battery-operated detectors, as described above, by offering continuous passive monitoring of a plurality of detecting units from a centrally located receiving unit. The receiving unit receives a periodic battery status signal from each detecting unit. A transmitting circuit located within the detecting unit sends a radio frequency signal to a receiving unit that is conveniently located to alert the home owner of the battery status and also signal a visual and/or an audio alarm to alert the owner in the case of an alarm condition in any of a multitude of detecting zones.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Figure 1:
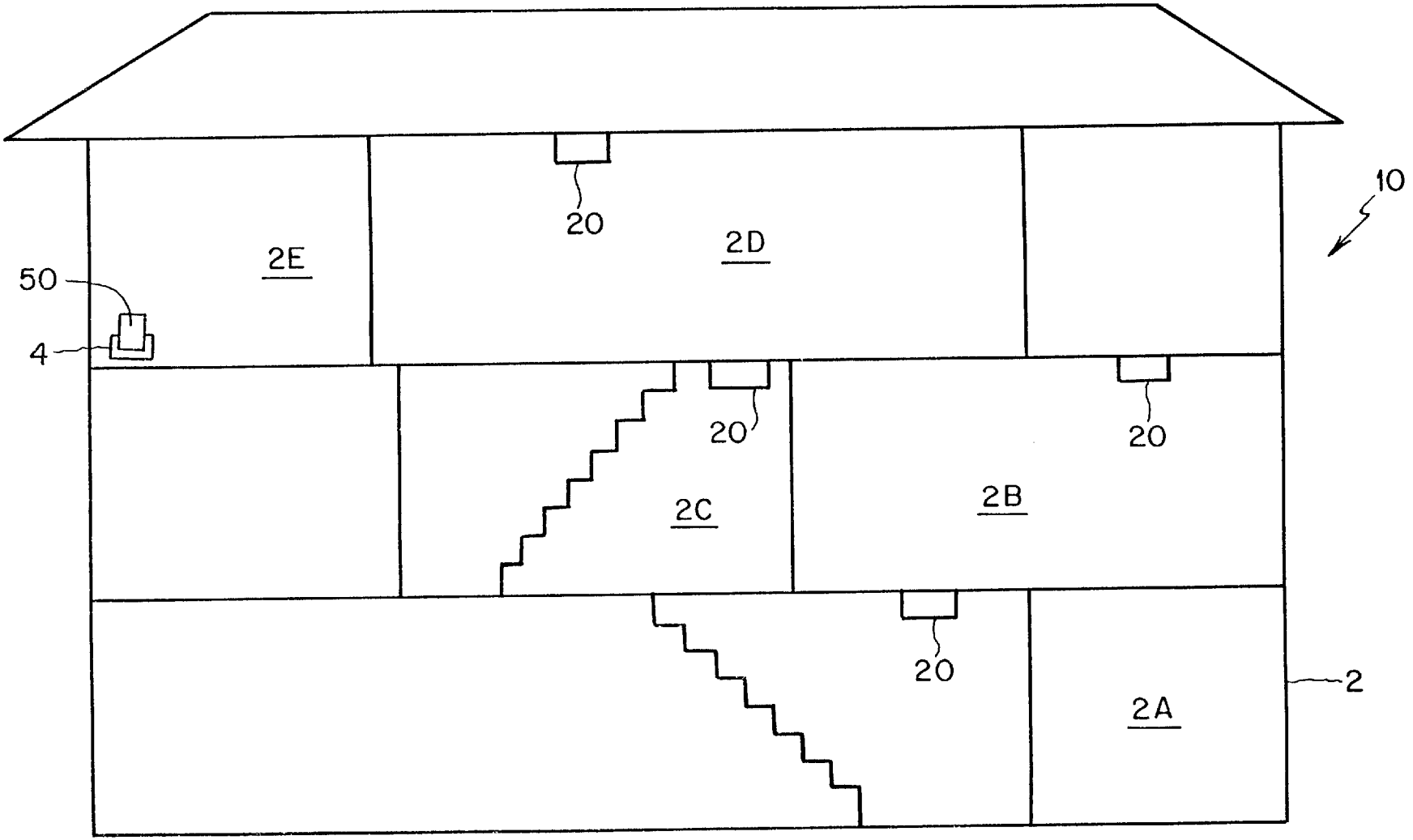
FIG. 1 is a pictorial, cross sectional view of a residence having a system formed in accordance with the present invention installed therein.

Referring initially to FIG. 1, a system 10 for detecting the existence of a hazardous condition within a building is shown. It is to be appreciated that such hazardous conditions to be detected by the system includes, for example, the presence of smoke, flames, gas or the like. The building in which the system 10 is installed may be any type of building in which the detection of hazardous conditions is critical to saving lives and/or property. While FIG. 1 illustrates the system 10 installed in a residence 2, the building could easily be an office, a factory, etc. Also, the actual positioning of the system, as shown in FIG. 1, within residence 2 is best suited for a smoke detecting system; however, flame or gas detecting system formed in accordance with the present invention may be installed in a different configuration. Nonetheless, it is the unique cooperation between the components of the present invention, which will be described herein, rather than their precise location within a building, that provides one of the advantages that the present invention has over the prior art. However, the ability to place the detecting unit of the present invention in places within the building which are substantially inaccessible or difficult to get to (e.g., attics) provides a further advantage over conventional detecting units which must be substantially accessible in order to test the battery therein.

The system 10 of the present invention basically includes a plurality of battery-powered detecting units 20 and at least one receiving unit 50. It is to be understood that while only one receiving unit 50 is shown to operate with four detecting units 20, in the context of FIG. 1, it is within the scope of the present invention to have a system with multiple receiving units 50 respectively operating with multiple pluralities of detecting units 20. It is also within the scope of the present invention to form a system with a single receiving unit 50 operating with more than four detecting units 20. More than one of these type systems may also operate together. As exemplified in FIG. 1, the system 10 is shown to include a first detecting unit 20 mounted in a basement just outside a boiler room 2A, a second detecting unit 20 mounted in a kitchen 2B, a third detecting unit 20 mounted in a downstairs hallway 2C and a fourth detecting unit 20 mounted in an upstairs hallway 2D. Also, a receiving unit 50 is plugged into an AC outlet 4 in a master bedroom 2E. In this configuration, as will be described in greater detail later, the receiving unit 50 will advantageously alert an owner of the resident sleeping in bedroom 2E, that a hazardous condition has been detected within the residence and, further, the system will inform him or her precisely where the hazardous condition is located.

A preferred form of the battery-powered detecting unit 20 is shown in FIGS. 2A through 2G. The detecting unit 20 includes a housing 22 having a cover 24 pivotally attached thereto by a hinge 28. A lip 26 on an opposing side of the cover 24 serves as a latch for permitting selective opening of cover 24 pivotally on hinge 28. The ability to selectively open cover 24 permits access to the electronics of the detecting unit 20, which will be discussed in greater detail later.

Figure 2B:
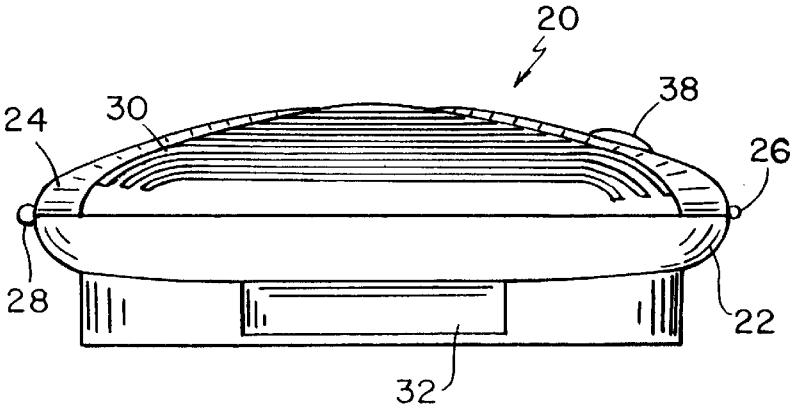
FIGS. 2A through 2G are perspective, opposing side elevations, bottom plan, front elevation, rear elevation and top plan views, respectively, of a detecting unit formed in accordance with the present invention.
Figure 2C:
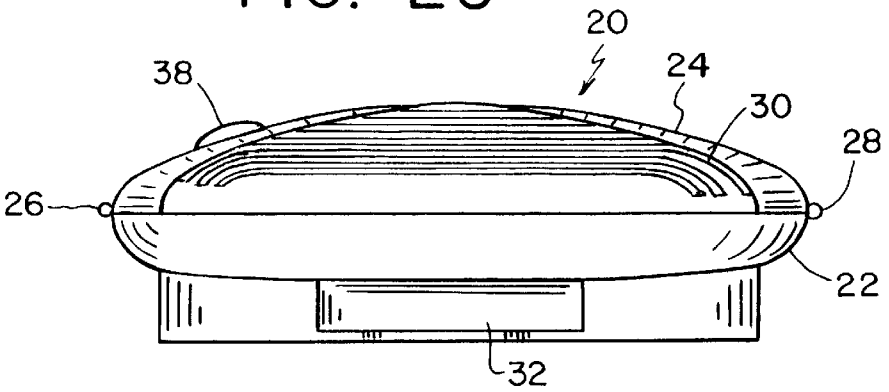
Figure 2A:
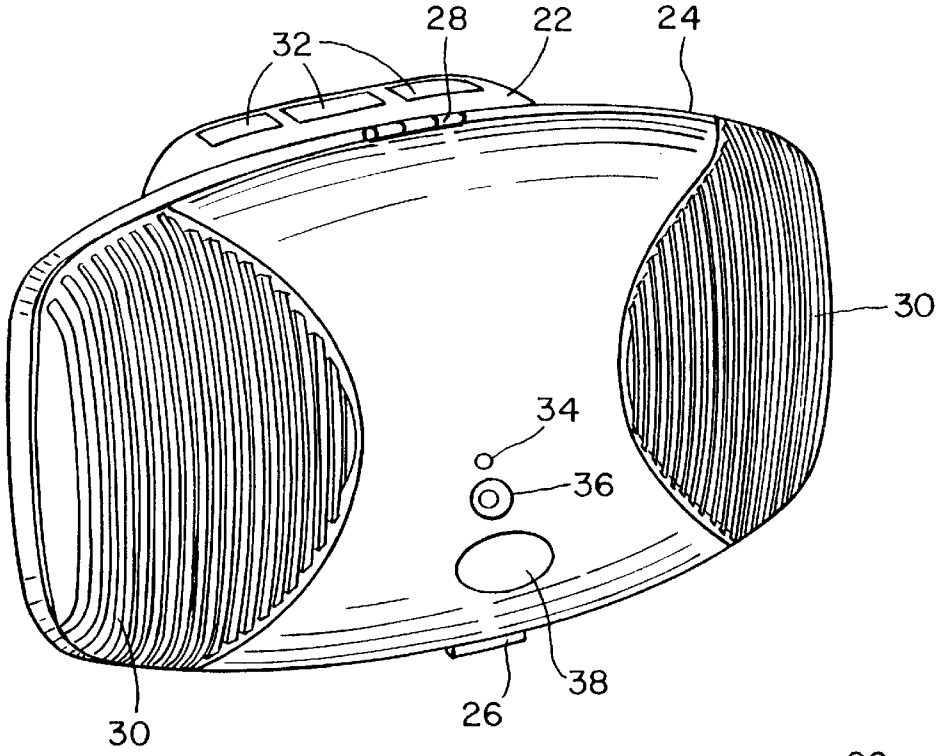
Figure 2E:
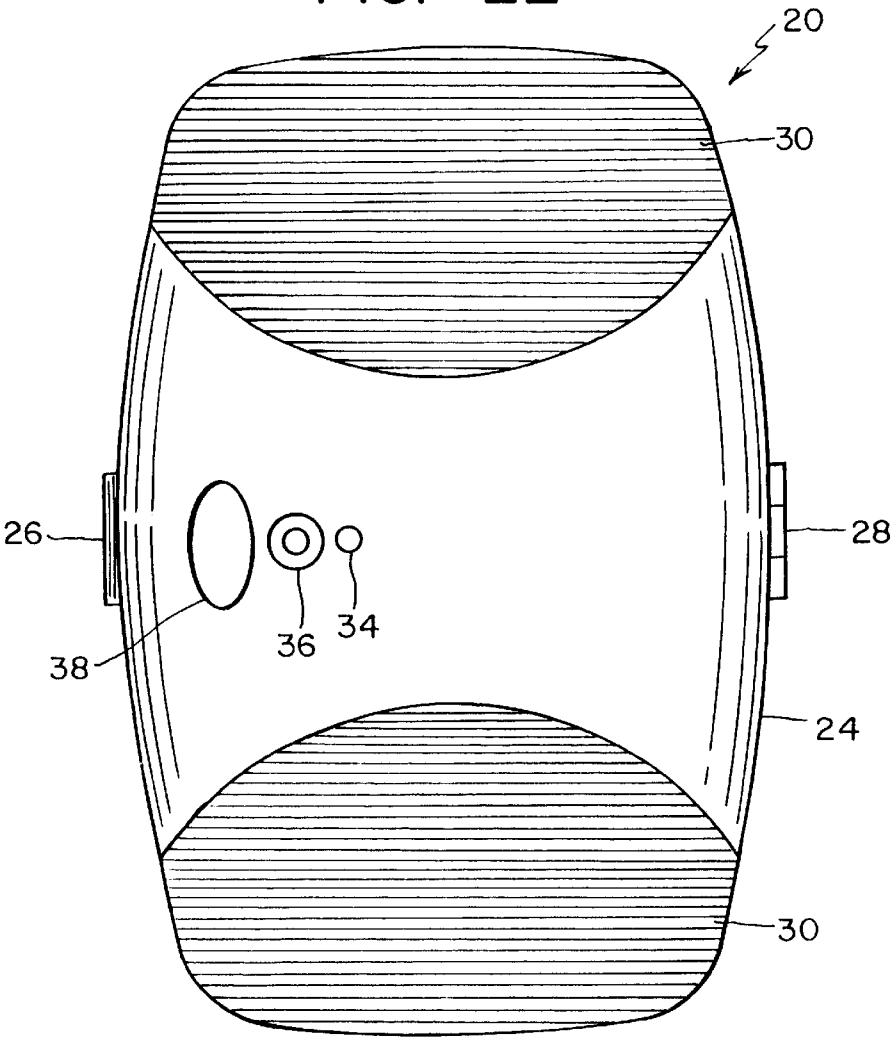
Figure 2D:
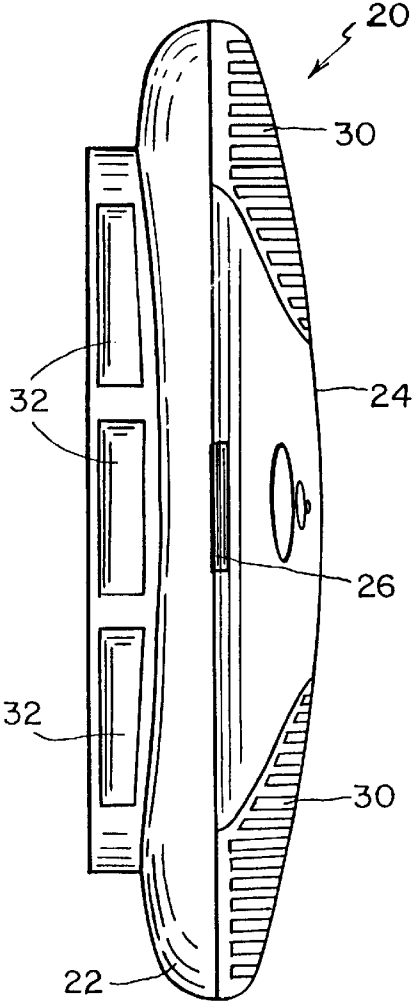
Figure 2G:
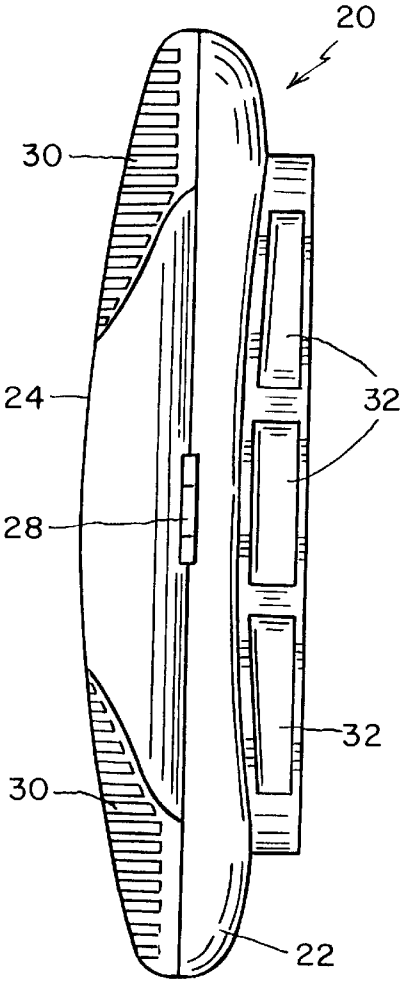

The cover 24 includes speaker grills 30 formed therein, as best shown in FIGS. 2A and 2E. Speaker grills 30 serve as openings for an audible warning alarm to be broadcast from detecting unit 20 during the detection of the hazardous condition. However, grills 30 also permit smoke, infrared radiation from flames or gas to sufficiently permeate the interior of the units 20 so that such hazardous conditions may be detected and responded to in accordance with the present invention. The housing 22 further includes vent openings 32 (FIGS. 2A, 2B, 2F and 2G) formed therein. The vent openings 32 are formed in the detecting unit 20 in order to further permit permeation of the elements of the hazardous condition (smoke, radiation and gas) into unit 20.

Figure 2F:
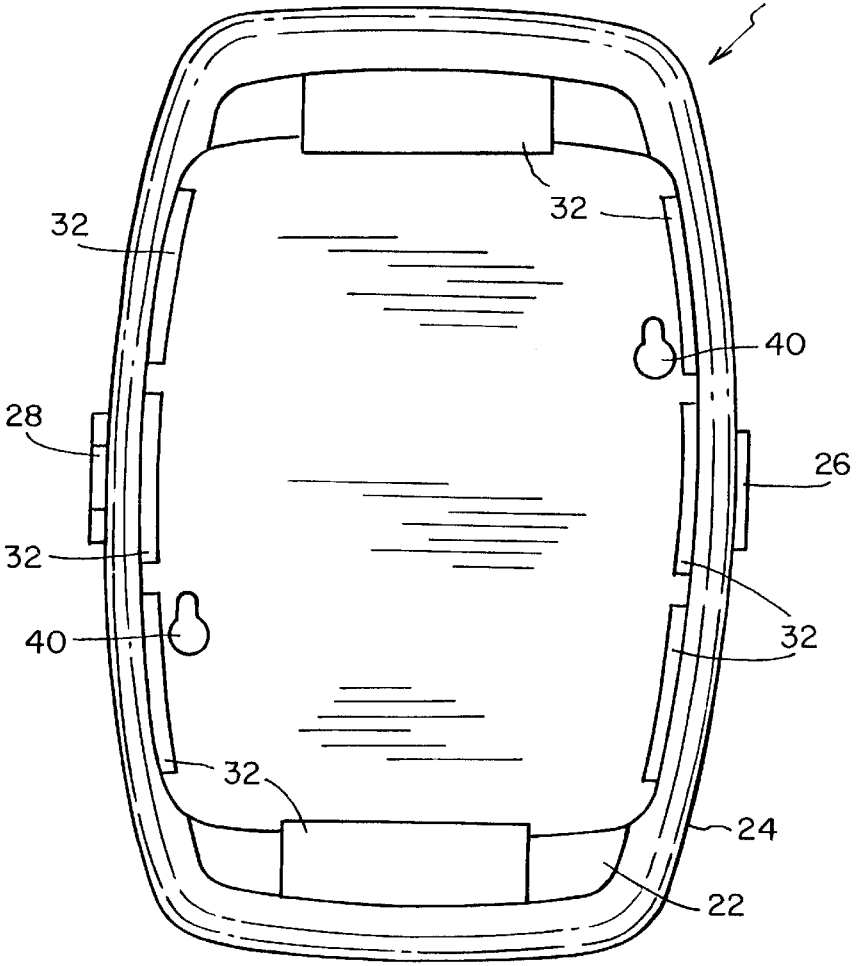

Further, the detecting unit 20 also preferably includes LED 34, a test pushbutton switch 36 and a hush (reset) pushbutton switch 38 mounted on the cover 24. The functions of these controls will be explained during the explanation of the basic operation of the present invention to follow. Also, as shown in FIG. 2F (a rear view of the detecting unit 20), two mounting holes 40 are provided in housing 22 which permit the unit to be mounted to either a ceiling (as shown in FIG. 1) or a wall within a building.

Figure 3B:
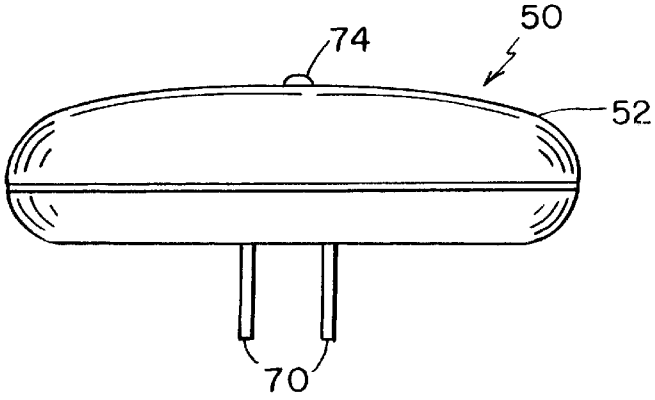
FIGS. 3A through 3G are perspective, top plan, bottom plan, front elevation, opposing side elevations and rear elevation views, respectively, of a receiving unit formed in accordance with the present invention.
Figure 3C:
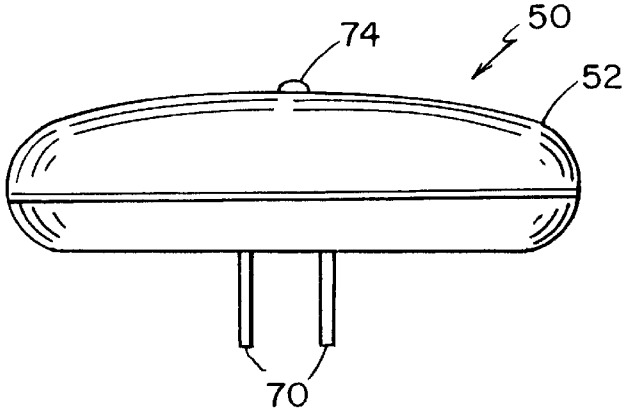
Figure 3A:
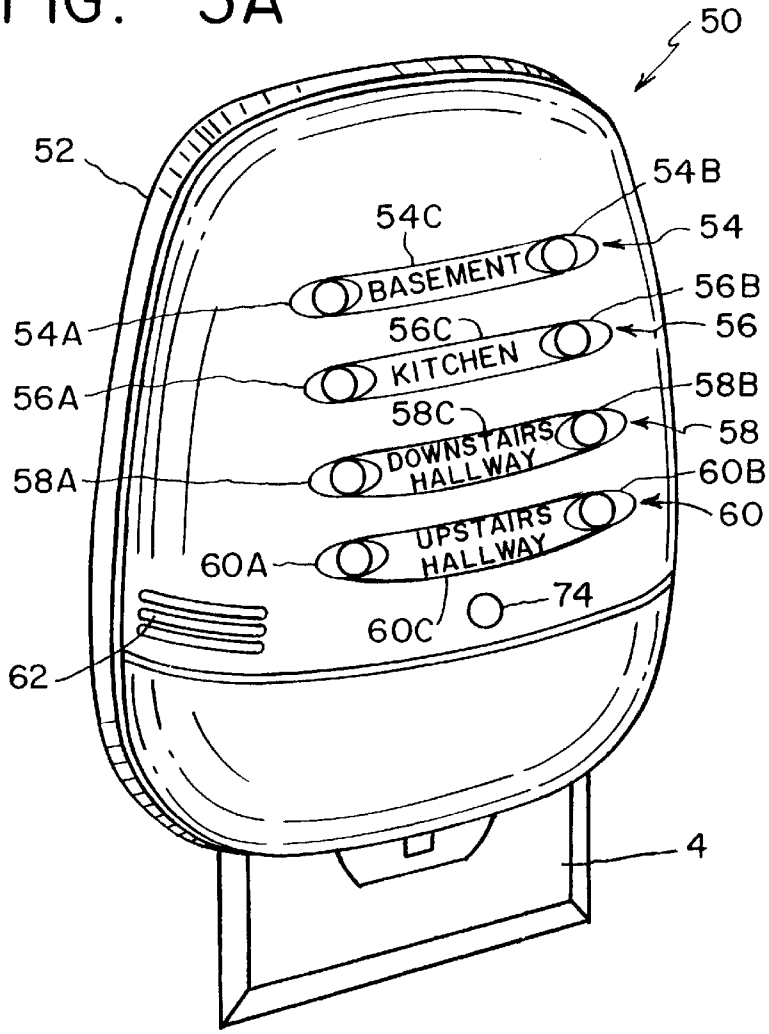
Figure 3E:
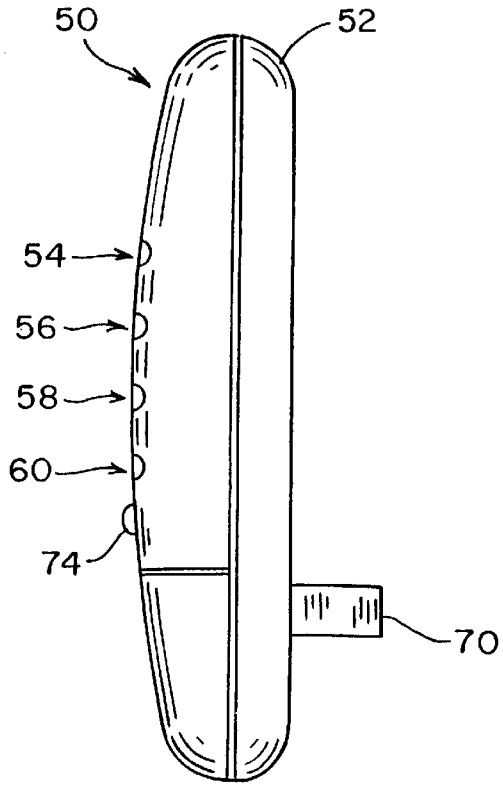
Figure 3D:
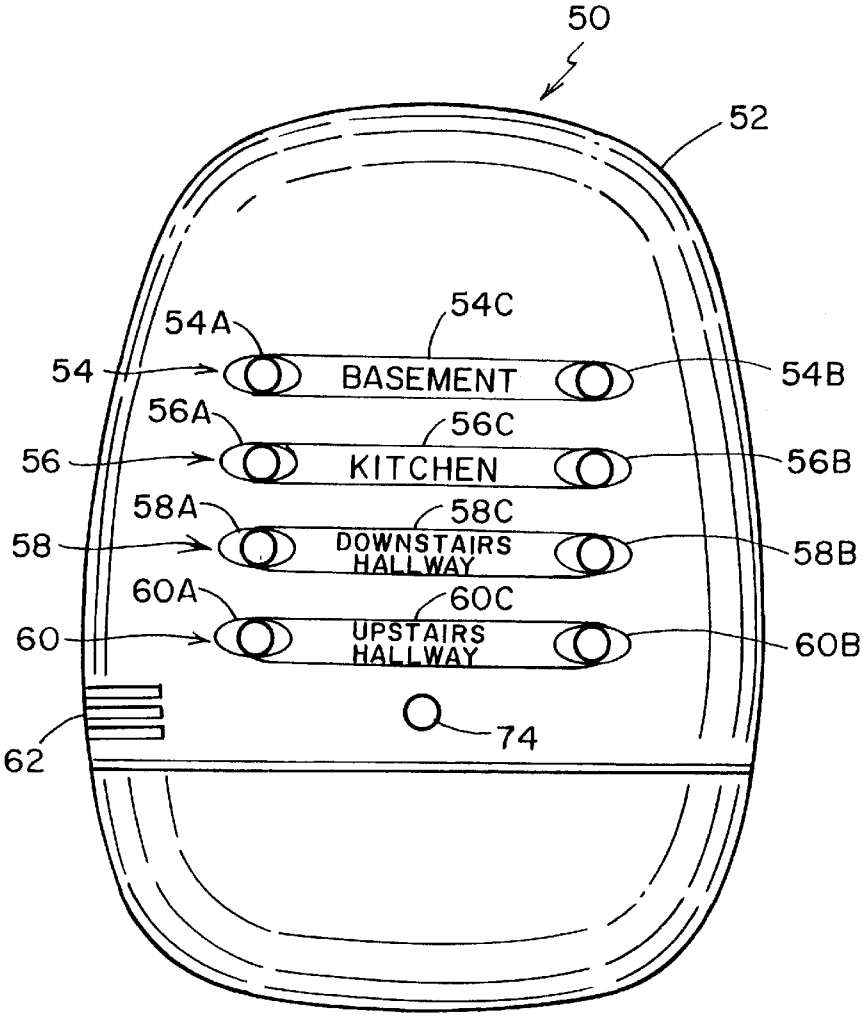
Figure 3G:
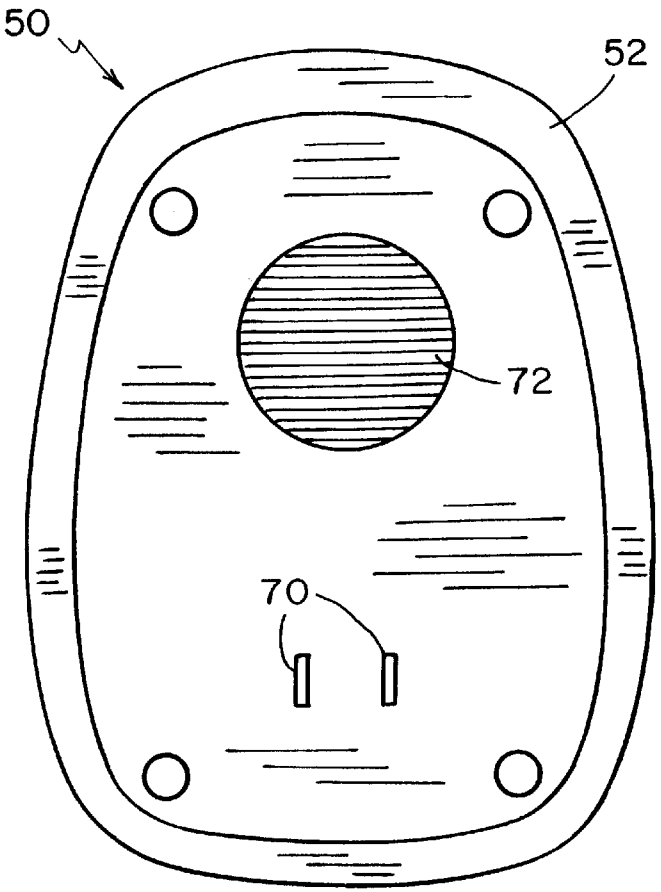

A preferred form of a receiving unit 50 is shown in FIGS. 3A through 3G. The receiving unit 50 includes a housing 52, visual indicator sets 54 through 60 and a speaker grid 62. Each visual indicator set, 54 through 60, includes a green light emitting diode (LED), 54A through 60A, and a red LED, 54B through 60B. Also, each visual indicator set, 54 through 60, has a label area, 54C through 60C, positioned between the green and red LEDs for providing an area to designate each set of visual indicators. For example, the name of the room within the residence in which the detecting units are mounted may be written in the label area in order to identify which visual indicator set is associated with which detecting unit (FIGS. 3A and 3D).

Figure 3F:
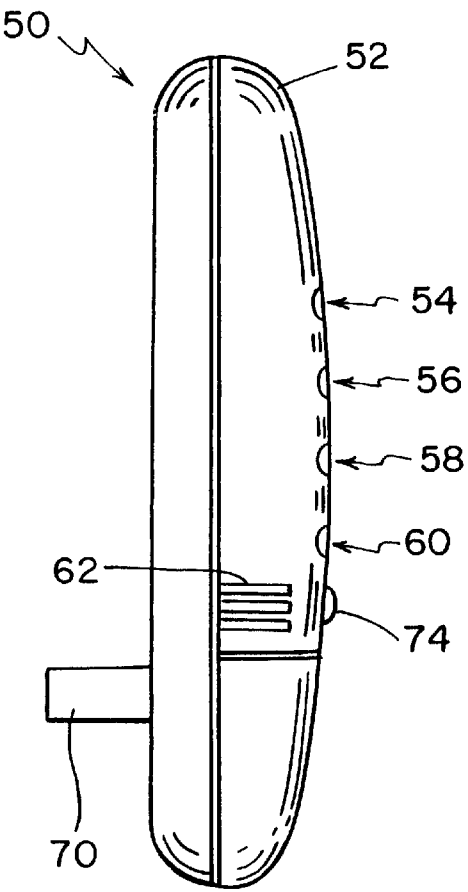

As shown in FIGS. 1 and 3A, receiving unit 50 is preferably powered via AC power provided from AC outlet 4. Accordingly, AC plug 70 is provided on the receiving unit 50, in the rear of housing 52, which engages AC outlet 4. Furthermore, receiving unit 50 includes a vent 72 also formed in the rear of housing 52 (FIG. 3F). Vent 72 permits ventilation for the electronic components contained in the receiving unit 50, which will be described in greater detail later. The receiving unit also includes a hush (reset) pushbutton switch 74 mounted below the sets of visual indicators on housing 52 of the receiving unit. The function of the pushbutton switch 74 will be described below.

The basis operation of system 10 of the present invention will now be explained, followed by a detailed description of a preferred implementation of the detecting unit 20 and the receiving unit 50. Each battery-powered detecting unit 20 contains electronics for generating a battery status signal and a hazardous condition alert signal. The battery status signal is generated and transmitted by each detecting unit 20 if the battery (or batteries) which provides power for the electronic components contained therein is at an acceptable voltage level. The acceptable voltage level may vary depending on the type of battery utilized in the system.

The battery status signal is preferably periodically generated and transmitted in order to minimize the power drain on the battery powering the detecting unit 20. In a preferred embodiment, the battery status signal is generated and transmitted approximately every four (4) hours. The transmission duration time is preferably approximately 1 second. It is to be understood that because most detecting units of detection systems are battery-powered, the need to minimize the drain on such batteries is critical. Accordingly, by advantageously transmitting the battery status signal periodically, in accordance with the present invention, a transmitter in the detecting unit need only be operational on a periodic basis, thus conserving power and extending the lifespan of the battery. This unique approach of the present invention is to be contrasted with the prior art system, previously discussed, which includes an RF receiver in the detecting unit for receiving a battery test signal from a remote control unit. In such a conventional detecting unit, it is necessary to keep the receiver continuously powered in order for the receiver to always be ready to receive the battery test signal. Thus, the battery in the conventional detecting unit is continually drained, thereby severely limiting its lifespan.

In addition to the battery status signal, the detecting unit 20 of the present invention generates and transmits a hazardous condition alert signal. The alert signal is generated if a hazardous condition is detected by the detecting unit 20. Specifically, if detecting unit 20 is part of a smoke detection system, then smoke permeating through at least one of the vent openings 32 and/or grills 30 causes detecting unit 20 to generate and transmit the hazardous condition alert signal. Furthermore, if the detecting unit 20 is part of a gas, flame (infrared radiation) or other type of detection system, then the permeation of such gas, infrared radiation or the like into detecting unit 20 will cause the alert signal to be generated and transmitted in a similar manner. The receiving unit 50 receives the battery status signals and the hazardous condition alert signals from each detecting unit 20 cooperatively operating with the receiving unit 50. It is to be appreciated that to distinguish which detecting unit 20 has transmitted which set of signals, each detecting unit 20 preferably encodes the battery status signal and alert signal with an address unique to each detecting unit 20. In addition, because a system may include more than one receiving unit 50, each detecting unit further encodes the signal transmission with an address to uniquely identify which receiving unit is adapted to receive and respond to a particular detecting unit's signals. In the same manner, the detecting unit/receiving unit address is preferably uniquely set within one detecting/receiving system so as not to interfere with a similar system of a neighboring residence.

In turn, the receiving unit 50 decodes the encoded signal (s) and thereby determines which detecting unit 20 has transmitted the battery status signal and/or the alert signal. Each set of visual indicators, 54 through 60, is respectively assigned to correspond with a particular detecting unit 20. Accordingly, if the receiving unit 50 receives a battery status signal from a particular detecting unit 20 within a predetermined time period, the green LED (54A through 60A) of the respective visual indicator will illuminate, thus indicating that the battery in the particular detecting unit 20 is at an acceptable level. However, if the receiving unit 50 does not receive the battery status signal from a particular detecting unit 20 within the predetermined time period, then the green LED will extinguish and the red LED (54B through 60B) of the particular visual indicator set will illuminate indicating that the battery in the detecting unit 20 is not at an acceptable level and requires replacement.

In a preferred embodiment, the predetermined time period may be twelve (12) hours. This means that if the receiving unit 50 does not receive at least one battery status signal within approximately a twelve (12) hour period (a detecting unit 20 preferably transmits a battery status signal approximately once every four hours) then the receiving unit will treat such absence of signal as an indication that the battery in the detecting unit has fallen below an acceptable level. Such a timing arrangement allows for the possibility that a battery status signal may have been sent out by a detecting unit 20 within the predetermined time period but was not properly received by the receiving unit 50. Such a situation may occur due to random RF interference which may interfere with the battery status signal. Thus, the predetermined time period for receiving the signal includes a margin of error to attempt to avoid having the system 10 give a false indication that the battery in a particular detecting unit is below the acceptable level when, in actuality, the battery is above the level but a false indication is triggered merely due to the fact that the receiving unit erroneously fails to receive the battery status signal each time it is transmitted.

As previously mentioned, the detecting unit 20 preferably generates a secondary status signal even after the battery status signal is no longer generated. The secondary status signal is preferably generated approximately two weeks after the last battery status signal is transmitted from the detecting unit 20. Similar to the battery status signal, the secondary status signal is transmitted approximately every four hours. Despite the fact that the battery voltage is below the acceptable level, the detecting unit is still able to generate and transmit the secondary status signal due to the low power requirements associated with the detecting unit and given the fact that, preferably, the battery voltage being below an acceptable level does not necessarily mean that the battery voltage is below an operable level with respect to detecting unit components.

The secondary status signal is received by the receiving unit and, in response, the receiving unit outputs an audible warning chirp through speaker grill 62. The chirp warning is intended to warn the user of the system that the battery has been below the acceptable level for some time and, therefore, the battery in the detecting unit 20 should be replaced as soon as possible.

In a similar fashion, each hazardous condition alert signal transmitted by the detecting units 20 is received and decoded by the receiving unit 50. In response to the receipt of an alert signal, the receiving unit 50 activates the set of visual indicators (54 through 60) corresponding to the detecting unit 20 which detected the hazardous condition such that both LEDs of the particular set of visual indicators begin to flash. Furthermore, in addition to the visual indication provided by the flashing LEDs, an audible warning is activated through speaker grill 62 of the receiving unit 50. The audible warning provides further indication that a hazardous condition has been detected by one of the detecting units 20 in the system. It is to be appreciated that a similar audible warning may be provided by detecting unit 20 through speaker grills 30 once a hazardous condition has been detected. Also, LED 34 mounted on cover 24 of detecting unit 20 preferably flashes when a hazardous condition is detected.

Advantageously, since the receiving unit 50 provides an area for designating which set of visual indicators correspond to which detecting unit (i.e., label areas 56C through 60C), a person may quickly determine the specific location of the hazardous condition by simply glancing at the receiving unit 50 to see which set of visual indicators is flashing. In this manner, the person need not waste valuable time in attempting to locate the condition and may instead plan an escape route from the building. Since a set of visual indicators is assigned to a particular detecting unit 20, the name of the room in which that detecting unit 20 is located may be designated on the label area, 54C through 60C, discussed above. For example, as shown on the receiving unit 50 of FIG. 3A, the visual indicator set 54 is labeled "basement", the visual indicator set 56 is labeled "kitchen", the visual indicator set 58 is labeled "downstairs hallway", and the visual indicator set 60 is labeled "upstairs hallway". Thus, the owner of the residence or any person therein may quickly determine where the hazardous condition is located by reading the label next to the flashing visual indicators.

Further, in a preferred embodiment, a unique audible warning may be provided by the receiving unit 50 to audibly distinguish which detecting unit 20 detected the hazardous condition and, thus, transmitted the alert signal. For example, referring to FIGS. 1 and 3A, if the detecting unit 20 in the basement 2A detected the hazardous condition and transmitted an alert signal to the receiving unit 50, the audible warning may, for example, include a one second beep followed by a one second silent period followed by a continuous repetition of this particular pattern. On the other hand, if the detecting unit in the kitchen 2B detects the condition and transmits an alert signal, the audible warning may include, for example, two beeps with a one second silent period followed by a continuous repetition of this particular pattern. In a similar manner, the other two detecting units designated on the receiving unit 50, in FIG. 3A, may provide similar unique audible patterns. In this way, a person need not even glance at the receiving unit 50 to view the flashing LEDs, but rather, can discern the location of the condition merely by listening to the audible warning pattern.

Furthermore, as previously mentioned, each detecting unit 20 includes a test pushbutton switch 36. The test pushbutton switch 36 initiates a test of the system 10 such that, when the pushbutton switch 36 is depressed, a test hazard condition alert signal is transmitted to the receiving unit 50. The receiving unit receives the test signal which causes the corresponding set of visual indicators (54 through 60) for the detecting unit 20 being tested to flash as if a hazardous condition has been detected. Also, the audible warning associated with the receiving unit 50 is sounded through speaker grill 62 of the receiving unit. It is also to be understood that the audible warning generated by the detecting unit 20 is also activated during this test mode and LED 34 mounted on the detecting unit will flash. A reset (i.e., hush) function is preferably provided on each detecting unit 20 and receiving unit 50. Pushbutton switch 38 on the detecting unit 20 serves to silence the alert condition (i.e., the sounding of the audible warning and flashing LED) when depressed, while the pushbutton switch 74 on the receiving unit 50 serves to silence the receiving unit's audible warning and to cease the flashing of the set of visual indicators (54 through 60). It is to be understood that the hush feature may also be activated when the system 10 is providing warnings during the actual detection of a hazardous condition. However, such feature is also useful when the system 10 is set off by a condition which is not necessarily hazardous, e.g., excess smoke from cooking in a kitchen where a detecting unit 20 is installed.

In an alternative preferred embodiment, the detecting unit 20 can send a hush signal to the receiving unit 50 when the hush pushbutton switch 38 is depressed at the detecting unit 20. The hush signal has the same effect on the receiving unit 50 that depressing hush pushbutton switch 74 has on the receiving unit. Still further, the hush signal may also be used to initially set-up the system, i.e., provide an indication to the receiving unit 50 that the battery voltage is not below the acceptable level without the receiving unit having to wait for the detecting unit to periodically transmit its normal battery status signal indicating the same. This is a useful function for when the system is initially installed in a residence such that the user can immediately cause the receiving unit to indicate whether or not the battery voltage is below the acceptable level.

Figure 5:
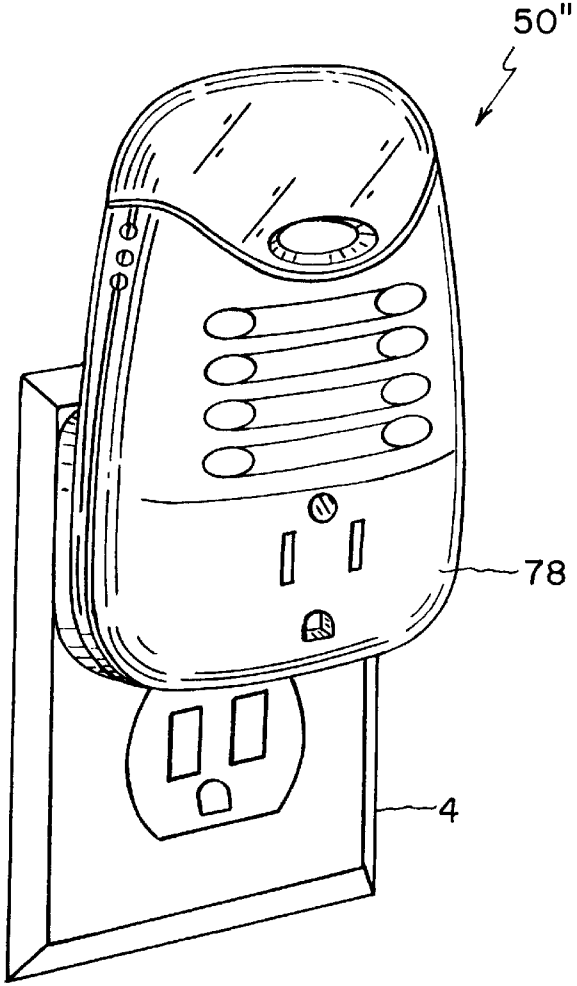
FIG. 5 is a perspective view of yet another embodiment of a receiving unit formed in accordance with the present invention.
Figure 4:
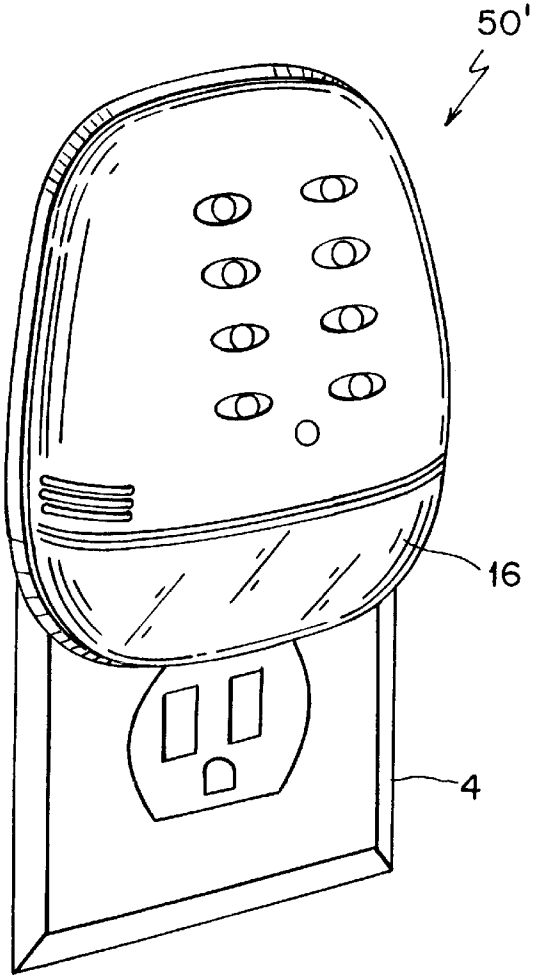
FIG. 4 is a perspective view of a further embodiment of a receiving unit formed in accordance with the present invention.

Referring now to FIGS. 4 and 5, alternative embodiments of the receiving unit 50 are illustrated. Particularly, a receiving unit 50' is shown in FIG. 4 which is substantially functionally and structurally the same as the receiving unit 50 previously described herein, with the exception that a nightlight 76 is provided thereon. Because the receiving unit 50' plugs into an AC outlet 4, the nightlight 76 serves to illuminate the immediate area in the vicinity of the receiving unit 50 so that it is possible to more easily read the label areas, 54C through 60C, on the visual indicator sets. It is also to be appreciated that receiving unit 50' may further include a rechargeable battery as its power source such that the receiving unit 50' may function as a flashlight when removed from the AC outlet 4. Preferably, the receiving unit 50' automatically switches over to the rechargeable battery as its source of power when removed from the AC outlet 4.

Still further, FIG. 5 illustrates a receiving unit 50" which is also similar in function and structure to receiving unit 50, but which also has a built-in AC outlet 78 which permits an AC plug from an appliance, for example, to be inserted therein and to draw power from the AC outlet 4 without removing the receiving unit 50" therefrom.

Figure 6A:
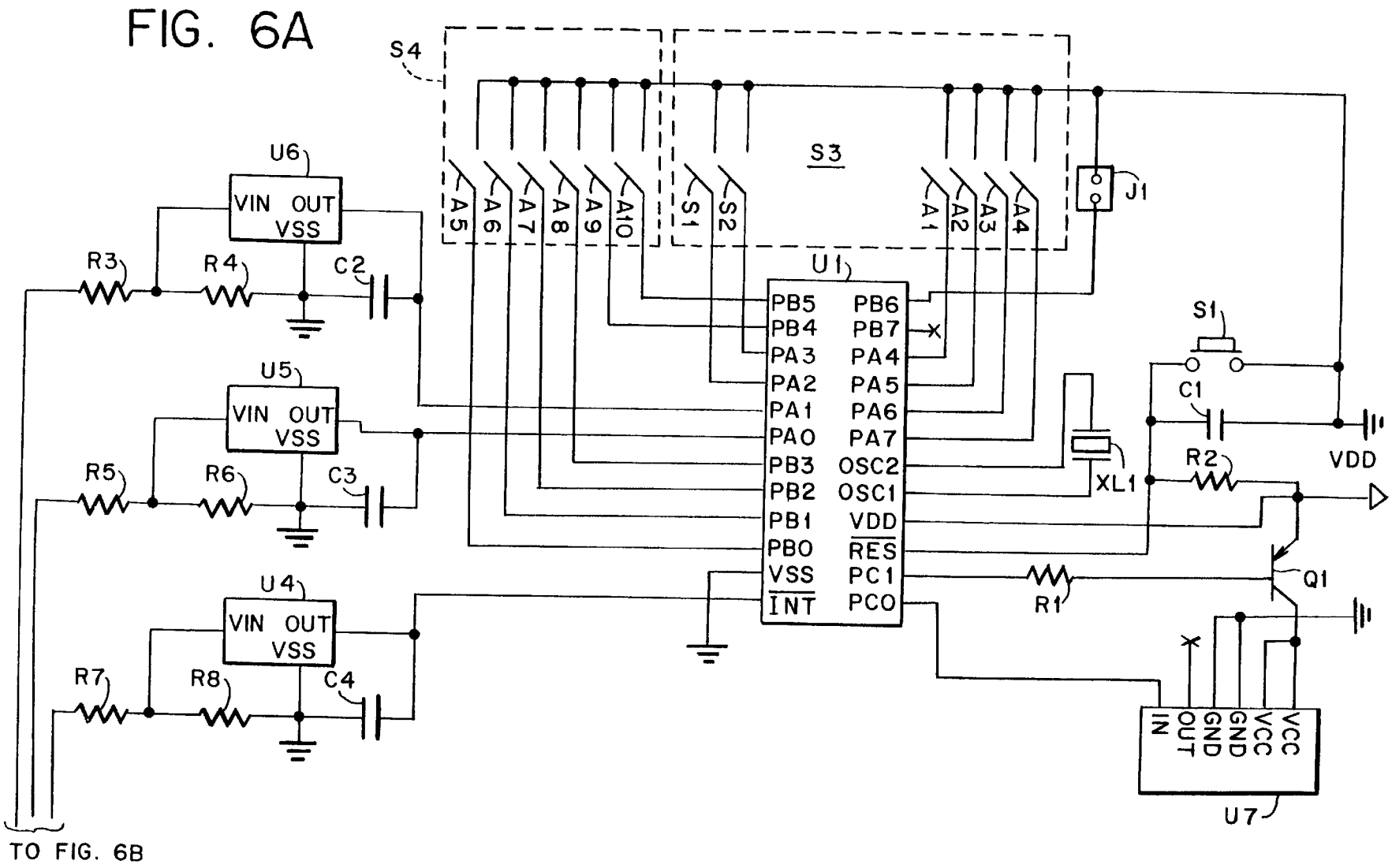
FIGS. 6A and 6B is a schematic diagram of a preferred embodiment of a electronic circuit used in a detecting unit formed in accordance with the present invention.
Figure 6B:
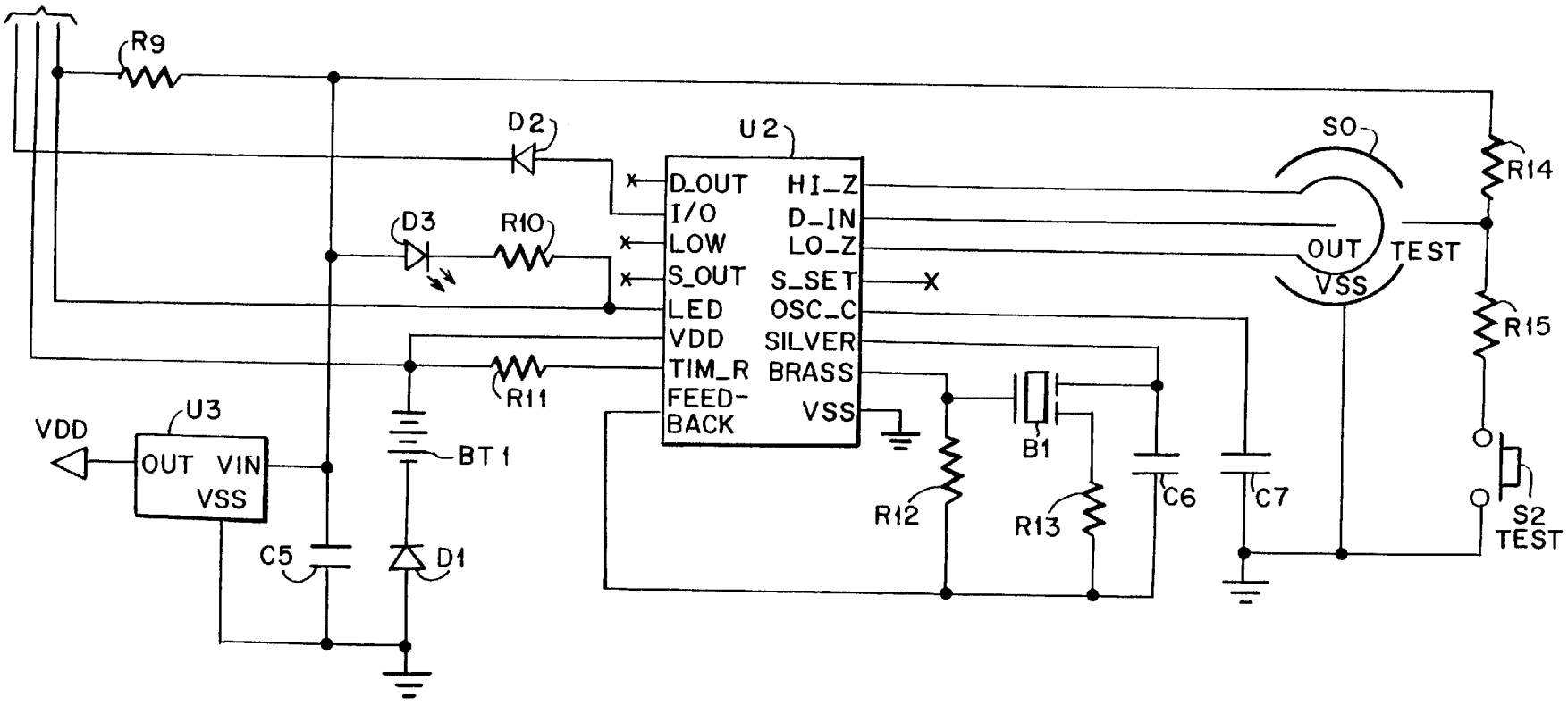

Referring now to FIGS. 6A and 6B, a preferred implementation of a circuit for performing the functions of the detecting unit 20 is shown. The detecting unit circuit may be considered to include three functional subcircuits for performing the various functions described herein. Accordingly, the detecting unit circuit generally includes a sensing circuit, a battery level monitoring circuit and a transmitting circuit. Other electronic components are shown in FIG. 6 which serve peripheral functions and will be discussed, as needed, to explain the novel features of the present invention.

The sensing circuit generally includes a hazardous condition detector S0 and a detector controller U2 operatively coupled thereto. It is to be appreciated that the preferred implementation of the present invention is for smoke detection; therefore, detector S0 and controller U2 are preferably smoke detecting type devices (e.g., ionic type). However, as previously mentioned, such components may be substituted with infrared or gas (e.g., carbon monoxide) detecting devices. The sensing circuit also includes a microcontroller U1 and a voltage detector U6 operatively coupled between controller U2 and microcontroller U1. It is to be appreciated that, as will be explained, the microcontroller U1 is preferably programmed to provide particular functionality in all of the subcircuits of the detecting unit. The sensing circuit also generally includes a buzzer B1 operatively coupled to detector controller U2.

On the other hand, the battery level monitoring circuit generally includes battery BT1 and voltage detector U5 operatively coupled thereto. The battery BT1 is the source of power for the entire detecting unit 20 and is, therefore, being monitored to determine whether it is above or below an acceptable level. The voltage detector U5 is operatively coupled to the microcontroller U1 which also functions in the battery monitoring circuit, as will be explained. Lastly, the transmitting circuit of the detecting unit generally includes microcontroller U1 operatively coupled to an oscillator XL1, a switch bank S3, a switch bank S4 and an RF module U7.

The operation of the detecting unit 20, in the context of the preferred circuit implementation of FIGS. 6A and 6B, will now be described. Battery BT1, which is preferably a +9 VDC battery, is monitored by voltage detector U5. Voltage detector U5, in response to the voltage level of BT1, generates and provides a discrete signal to microcontroller U1. The discrete signal informs microcontroller U1 whether the battery BT1 is above or below an acceptable voltage level. The microcontroller U1 monitors the discrete signal sent by the voltage detector U6.

Oscillator XL1 provides a clock signal to microcontroller U1 which microcontroller U1 uses to determine when to generate and transmit a battery status signal to the receiving unit 50. As previously mentioned, it is preferred that a battery status signal be generated and transmitted every 4 hours; thus, oscillator XL1 is chosen to generate a clock signal which provides such required timing. Therefore, in accordance with the clock signal, microcontroller U1 generates the battery status signal if the discrete signal from the voltage detector U5 indicates that the battery BT1 is at an acceptable level.

However, as previously mentioned, the battery status signal is encoded in order for the receiving unit 50 to determine which detecting unit 20 sent the signal. Also, the signal must be further encoded to indicate which receiving unit 50 (in a multiple receiving unit system) is to receive and respond to the battery status signal. Switch banks S3 and S4 provide such encoding function. Specifically, switches S1 and S2 of switch bank S3 are used to uniquely identify each detecting unit 20 and, therefore, the signals transmitted therefrom. In a preferred system utilizing four detecting units 20 for each receiving unit 50 (FIG. 1), switches S1 and S2 of switch bank S3 may be set to ON or OFF positions, as shown in Table I, to uniquely identify each detecting unit. If more than four detecting units 20 are being operated with a receiving unit 50, it should be understood that more switches may be added to provide for unique identification thereof

TABLE I

| DETECTING UNIT # | SWITCH S1 OF SWITCH BANK S3 | SWITCH S2 OF SWITCH BANK S3 |
|---|---|---|
| 1 | ON | ON |
| 2 | OFF | ON |
| 3 | ON | OFF |
| 4 | OFF | OFF |

On the other hand, switches A1 through A10 of switch banks S3 and S4 are used to uniquely identify the receiving unit 50 with which a particular detecting unit 20 is to operate. In other words, the positions of switches A1 through A10 (ON or OFF) must be set the same in each of the four detecting units 20 operating with a particular receiving unit 50 (as will be explained, the receiving unit has a similar switch bank to match the address set in the detecting unit). If a second set of four detecting units and one receiving unit is to be operated within the broadcasting range of a first set, then, while all detecting units and receiving unit in the second set must have the same settings for switches A1 through A10, such settings must be different as compared to the settings of A1 through A10 in the detecting units and receiving unit of the first set. In this manner, only the proper receiving unit 50 will respond to its properly matched detecting units 20.

Therefore, microcontroller U1 monitors the settings of the switches of switch banks S3 and S4 and, in response, encodes the battery status signal so that it is uniquely identified with respect to the detecting unit and the receiving unit. The encoded battery status signal is sent to RF module U7 where it is transmitted from detecting unit 20.

When a hazardous condition, such as smoke, is present in the area of the detecting unit 20, the smoke permeates the speaker grills 30 and/or the vent openings 32 (FIGS. 2A through 2G) and is sensed by hazardous condition (smoke) detector S0. In response to detector S0, the detector controller U2 activates buzzer B1 which provides the audible warning, through speaker grills 30, that the hazardous condition has been detected by the detecting unit 20. At the same time, voltage detector U6 is monitoring detector controller U2 such that when a hazardous condition is detected by detector S0, voltage detector U6 sends a discrete signal to microcontroller U1 informing U1 of the existence of the condition.

In a similar fashion to that described above, microcontroller U1 generates a hazardous condition alert signal which is encoded in the same manner as the battery status signal. One main difference between the alert signal and the battery status signal is that the battery status signal is periodically generated and transmitted, while the alert signal is generated whenever a hazardous condition is detected. It is possible that both signals are generated within close time proximity to one another such that microcontroller U1 may generate a combined encoded status signal containing both signals. Nevertheless, RF module U7 receives the encoded alert signal from microcontroller U1 and, in response, transmits the signal to receiving unit 50.

Reset (hush) switch S1 (shown as pushbutton 38 in FIG. 2A) is operatively coupled to the microcontroller U1 and provides a reset signal to microcontroller U1 to silence the audible warning provided by the detecting unit and to extinguish LED 34 which flashes when the hazardous condition alert signal is being transmitted. Also, a test pushbutton switch S2 (shown as pushbutton 36 in FIG. 1) is operatively coupled to the microcontroller U1 and provides a test signal which causes detecting unit 20 to enter a test mode to test its audible warning and to transmit a test hazardous condition alert signal to the receiving unit 50. Reset button S1 may preferably be able to override (e.g., cease) the test sequence once initiated by depressing test switch S2.

Furthermore, a voltage regulator U3 is included in detecting unit 20 for regulating the operating voltage level provided to microcontroller U1 and RF module U7. Also, a third voltage detector U4 is included in unit 20 which generates an interrupt signal which is provided to the microcontroller U1. If jumper J1 is closed, microcontroller U1 will go into a rapid test mode upon receipt of the interrupt signal whereby, instead of generating a battery status signal every four hours, the microcontroller U1 will generate a battery status signal in a shorter time period, for example, every 40 seconds. This feature is preferably disabled in normal operation mode and is provided basically for system troubleshooting and final production testing purposes. In other words, the user of the system would not ordinarily operate the system in this rapid test mode.

Figure 7A:
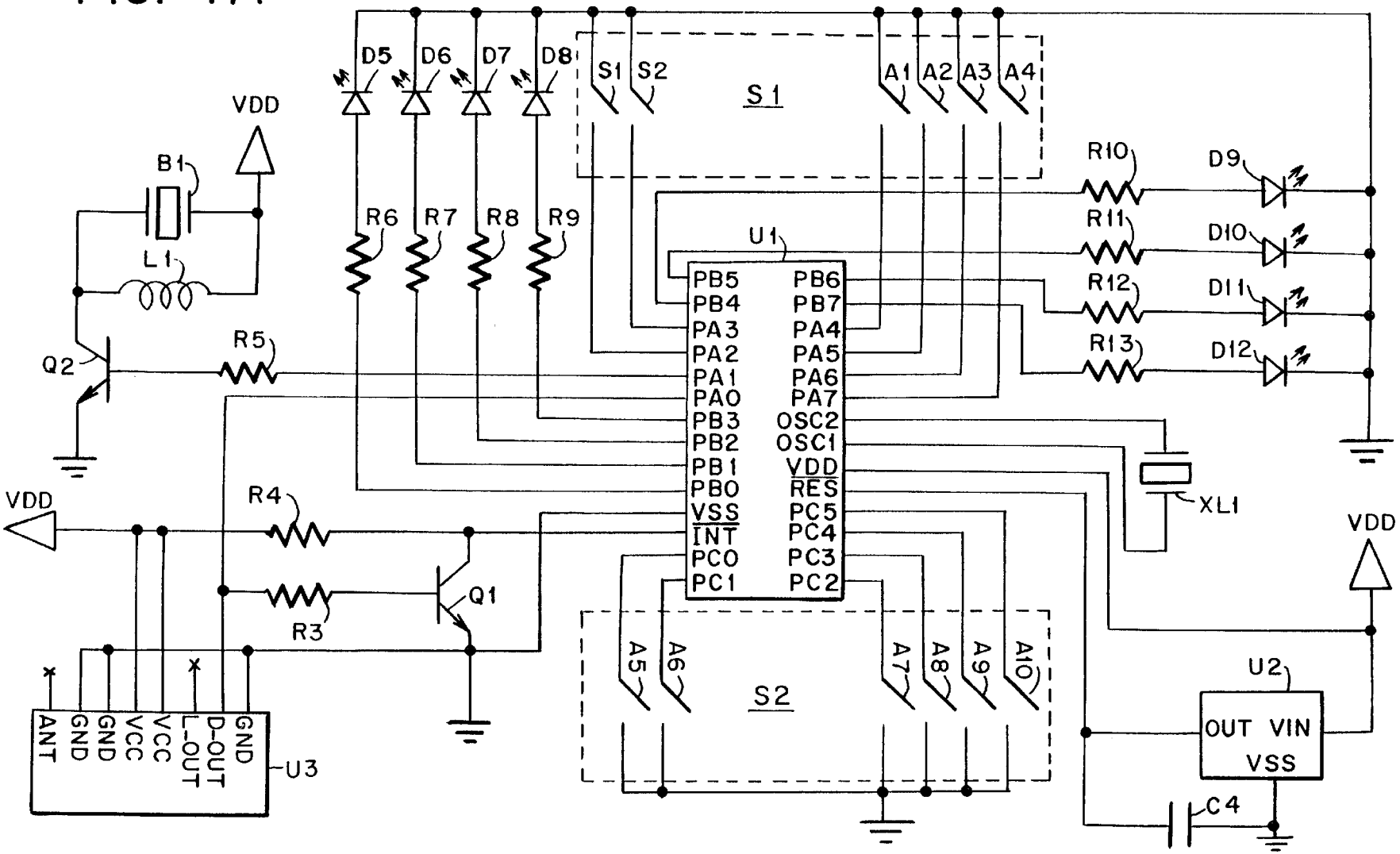
FIGS. 7A and 7B is a schematic diagram of a preferred embodiment of a electronic circuit used in a receiving unit formed in accordance with the present invention.
Figure 7B:
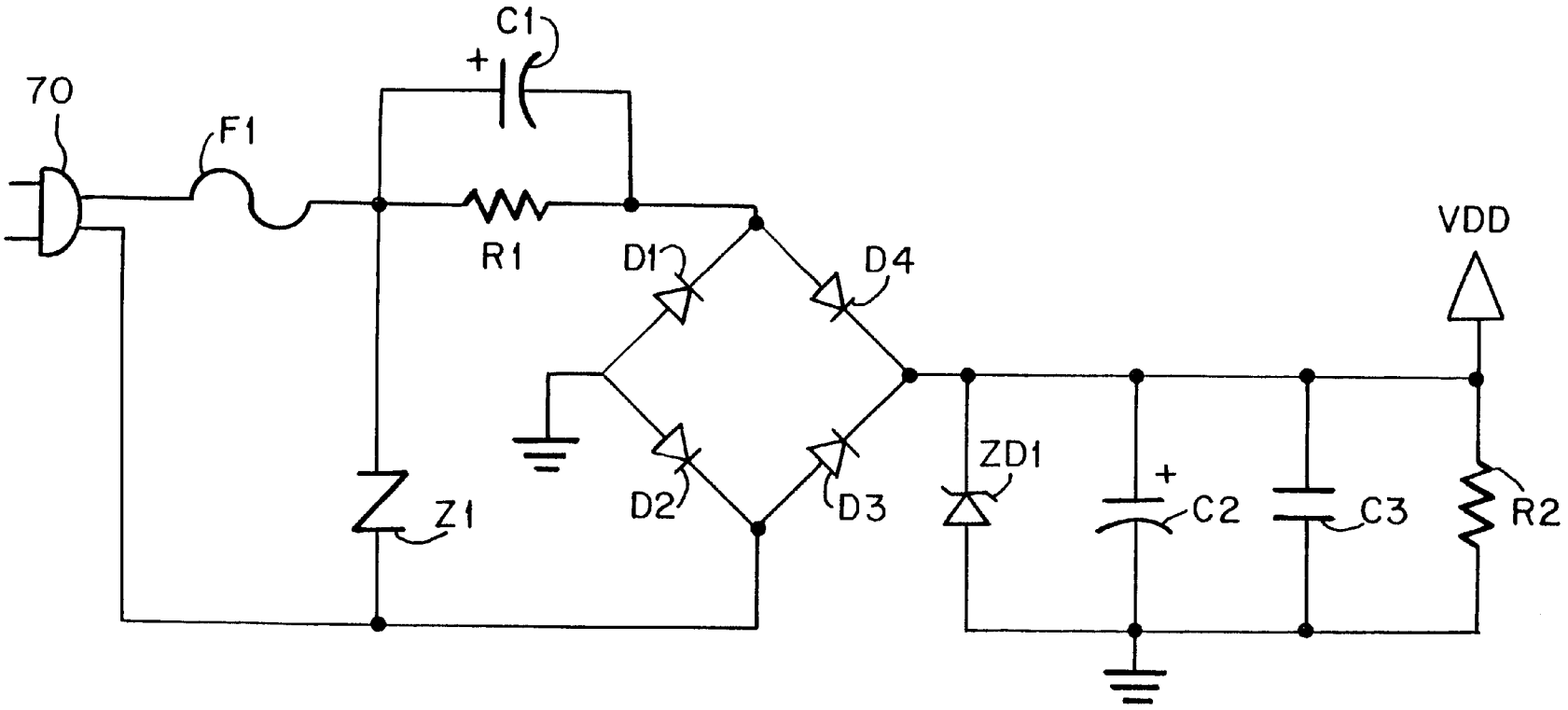

Referring now to FIGS. 7A and 7B, a preferred implementation of a receiving unit circuit for performing the functions of receiving unit 50 is shown. The receiving unit circuit may be considered to include four functional subcircuits for performing the various functions described herein. As with the detecting unit circuit, several components overlap in function between subcircuits, e.g., microcontroller U1. The receiving unit circuit generally includes a receiving circuit, a battery status indicating circuit, a hazardous condition alert circuit and a power supply circuit. Again, other electronic components are shown in FIGS. 7A and 7B which serve peripheral functions and will be discussed, as needed, to explain the novel features of the present invention.

Basically, the power supply circuit includes AC plug 70 (FIGS. 3A through 3G), capacitors C1 through C3, fuse F1, resistors R1 and R2, thyristor device Z1, diode bridge, D1 through D4, and Zener diode ZD1. Such power supply circuit operates as a conventional full wave bridge rectifier circuit and converts the AC power supplied by the AC outlet 4 (FIG. 3A), in which AC plug 70 is inserted, to a DC voltage, $V_{DD}$, which is utilized by the electronic components of the receiving unit 50.

The receiving circuit generally includes an RF receiver module U3 operatively coupled to a microcontroller U1, and switch banks S1 and S2 also operatively coupled to the microcontroller U1. It is to be appreciated that microcontroller U1 in receiving unit 50 is preferably programmed to provide particular functionality in the receiving, battery level indicating and hazardous condition alert circuits. The battery status indicating circuit generally includes microcontroller U1, diodes D5 through D12 operatively coupled to microcontroller U1 through resistors R6 through R13, a buzzer B1 and a coil L1 operatively coupled through a transistor Q2 to microcontroller U1. The battery status indicating circuit also includes oscillator XL1 operatively coupled to microcontroller U1. Lastly, the hazardous condition alert circuit generally consists of microcontroller U1 and buzzer B1 and coil L1 operatively coupled to microcontroller U1 through transistor Q2.

The operation of the receiving unit 50, in the context of the preferred circuit implementation of FIGS. 7A and 7B, will now be described. RF module U3 receives an encoded battery status signal from one of the detecting units 20. The received signal is provided to the microcontroller U1 wherein, in accordance with the settings of switch banks S1 and S2, the signal is decoded. Microcontroller U1 will only respond to signals which are encoded by detecting units 20 in which the settings of switches A1 through A10 of switch banks S3 and S4 (FIG. 6) are set the same way as switches A1 through A10 of switch banks S1 and S2 in receiving unit 50. As previously mentioned, this unique address matching scheme is provided to permit multiple systems (e.g., two systems having one receiving unit and four detecting units) to operate within a common RF broadcasting area. Once the microcontroller U1 determines that it is the receiving unit set to receive the signal, microcontroller U1 further decodes the received signal to determine which of the four detecting units sent the signal. As previously explained, such identification is uniquely set by switches S1 and S2 of switch bank S3 of the detecting unit 20.

Further, LED's D5 through D12 comprise the visual indicator sets 54 through 60 (FIGS. 3A through 3G). Specifically, D5 is a red LED (54B) and D9 is a green LED (54A) and together they make up visual indicator set 54. D6 (red LED 56B) and D10 (green LED 56A) make up visual indicator set 56, D7 (red LED 58B) and D11 (green LED 58A) make up visual indicator set 58. D8 (red LED 60B) and D12 (green LED 60A) make up visual indicator set 60. Microcontroller U1 assigns one of the four visual indicator sets, 54 through 60, to one of the four detecting units 20 and can determine which detecting unit 20 sent which signal by decoding the two bit address encoded in the signal by switches S1 and S2 of switchbank S3 of the detecting unit 20. Furthermore, switches S1 and S2 of switchbank S1 of the receiving unit 50 may be utilized to selectively disable each set of visual indicators which is not assigned to a particular detecting unit, e.g., in a system with less than four detecting units in operation. The switches S1 and S2 of switch bank S1 (FIGS. 7A and 7B) may be set as shown in Table II, depending on how many detecting units 20 are operating with the receiving unit 50. If more than four detecting units 20 are being operated with a receiving unit 50, then more switches may be provided to selectively control the activation of their respective visual indicator sets.

TABLE II

| QUANTITY OF DETECTING UNITS IN SYSTEM | SWITCH S1 OF SWITCH BANK S1 | SWITCH S2 OF SWITCH BANK S2 |
|---|---|---|
| 1 | ON | ON |
| 2 | OFF | ON |
| 3 | ON | OFF |
| 4 | OFF | OFF |

Thus, microcontroller U1 receives the battery status signals through RF module U3 and, via their unique addresses, decodes the signals and then respectively illuminates each green LED (D9 through D12) if a battery status signal is received for that particular detecting unit 20. If a battery status signal is not received from a particular detecting unit 20 within a predetermined time period (set by a clock signal generated by oscillator XL1), then microcontroller U1 will extinguish the corresponding green LED and illuminate the corresponding red LED. As previously mentioned, the predetermined time period is preferably 12 hours. In this manner, a person need only glance at the receiving unit 50 to determine if the green LED or red LED is illuminated for a particular detecting unit 20. If the red LED is illuminated, he will know to change the battery in the corresponding detecting unit 20.

In a similar manner, RF module U3 may receive a hazardous condition alert signal transmitted by one of the four detecting units 20. Again, the microcontroller U1 decodes the signal and, based on whether or not there is an address match between switches A1 through A10 of the detecting and receiving units, the microcontroller U1 will further decode the signal to determine from which detecting unit the signal was transmitted. Once the microcontroller U1 makes such determination, the microcontroller U1 causes the set of visual indicators (56 through 60) corresponding to the detecting unit 20 that sent the hazardous condition alert signal to continually flash. This visual warning gives a person an indication as to which detecting unit 20 detected the condition and, thus, gives him an opportunity to act accordingly.

In addition, when an alert signal is received, microcontroller U1 activates buzzer B1 through transistor Q2 and coil L1. Similar to buzzer B1 in detecting unit 20, buzzer B1 in receiving unit 50 sounds an audible warning when an alert signal is received. Also, in a preferred embodiment, microcontroller U1 may cause buzzer B1 to sound a unique warning pattern depending on which detecting unit 20 detected the hazardous condition.

While the hush (reset) pushbutton switch 74 is not expressly shown in FIGS. 7A and 7B, it is to be appreciated that such switch operates in a similar manner to the reset switch S1 (pushbutton 38) shown in FIGS. 6A and 6B for the detecting unit, i.e., depressing reset pushbutton ceases alarm condition and, therefore, ceases flashing visual indicators and silences buzzer B1. In an alternative embodiment, a hush pushbutton switch may be included on the detecting unit 20 only and, when depressed, the detecting unit 20 transmits a reset signal, encoded in the manner described herein, to reset the receiving unit 50.

Voltage detector U2, shown in FIGS. 7A and 7B operatively coupled to microcontroller U1, is preferably provided to generate a microcontroller reset signal upon power-up of the receiving unit 50, e.g., when the unit is plugged into AC outlet 4. The microcontroller reset signal resets the microcontroller U1 upon power-up.

A parts list for the detecting circuit in FIGS. 6A and 6B is provided below in Table III, while a parts list for the receiving circuit in FIGS. 7A and 7B is provided below in Table IV. Additionally, the pin name designations on the integrated circuits in FIGS. 6A, 6B, 7A and 7B relate to parts specified in the parts list. It is envisioned that components comparable to those listed below, connected differently from that shown in FIGS. 6A, 6B, 7A and 7B, may be suitable to practice the present invention.

TABLE III

PARTS LIST FOR ELECTRONIC CIRCUIT ILLUSTRATED IN FIG. 6

| Reference Numeral | Part Identification | Value/Part No. |
|---|---|---|
| B1 | Buzzer | 400 kHz |
| BT1 | Battery | +9 VDC |
| C1 | Capacitor | 0.1 μf |
| C2 | Capacitor | 0.1 μf |
| C3 | Capacitor | 0.1 μf |
| C4 | Capacitor | 0.1 μf |
| C5 | Capacitor | 0.1 μf |
| C6 | Capacitor | 0.001 μf |
| C7 | Capacitor | 0.1 μf |
| D1 | Diode | 1N4148 |
| D2 | Diode | 1N4148 |
| D3 | LED | 3 mm |
| J1 | Jumper | |
| Q1 | Transistor | 2SA733 |
| R1 | Resistor | 30 k ohms |
| R2 | Resistor | 30 k ohms |
| R3 | Resistor | 50 k ohms |
| R4 | Resistor | 100 k ohms |
| R5 | Resistor | 50 k ohms |
| R6 | Resistor | 100 k ohms |
| R7 | Resistor | 50 k ohms |
| R8 | Resistor | 100 k ohms |
| R9 | Resistor | 50 k ohms |
| R10 | Resistor | 330 ohms |
| R11 | Resistor | 82M ohms |
| R12 | Resistor | 15M ohms |
| R13 | Resistor | 220 k ohms |
| R14 | Resistor | 1M ohms |
| R15 | Resistor | 1M ohms |
| S0 | Condition Detector | NIS-09 |
| S1 | Reset momentary pushbutton switch | |
| S2 | Test momentary pushbutton switch | |
| S3 | Dip switch bank (6 single pole single throw switches) | |
| S4 | Dip switch bank (6 single pole single throw switches) | |
| U1 | Microcontroller | HT48100 |
| U2 | Detector Controller | MC14468 |
| U3 | Voltage Regulator | RX5AL40A |
| U4 | Voltage Detector | 8053ALR |
| U5 | Voltage Detector | 8053ALR |
| U6 | Voltage Detector | 8053ALR |
| U7 | RF Module | RWS-315 |
| XL1 | Oscillator | 4 MHz |

TABLE IV

PARTS LIST FOR ELECTRONIC CIRCUIT ILLUSTRATED IN FIG. 7

| Reference Numeral | Part Identification | Value/Part No. |
|---|---|---|
| B1 | Buzzer | 400 kHz |
| C1 | Capacitor | 1 μf/250 V |
| C2 | Capacitor | 220 μf/16 V |
| C3 | Capacitor | 0.1 μf |
| C4 | Capacitor | 0.1 μf |
| D1 | Diode | 1N4004 |
| D2 | Diode | 1N4004 |
| D3 | Diode | 1N4004 |
| D4 | Diode | 1N4004 |
| D5 | LED | 3 mm |
| D6 | LED | 3 mm |
| D7 | LED | 3 mm |
| D8 | LED | 3 mm |
| D9 | LED | 3 mm |
| D10 | LED | 3 mm |
| D11 | LED | 3 mm |
| D12 | LED | 3 mm |
| F1 | Fuse | 1A/250 V |
| Q1 | Transistor | 2SC945 |

TABLE IV-continued

PARTS LIST FOR ELECTRONIC CIRCUIT ILLUSTRATED IN FIG. 7

| Reference Numeral | Part Identification | Value/Part No. |
|---|---|---|
| Q2 | Transistor | 2SC945 |
| R1 | Resistor | 100 k ohms |
| R2 | Resistor | 5.1 k ohms |
| R3 | Resistor | 30 k ohms |
| R4 | Resistor | 30 k ohms |
| R5 | Resistor | 30 k ohms |
| R6 | Resistor | 330 ohms |
| R7 | Resistor | 330 ohms |
| R8 | Resistor | 330 ohms |
| R9 | Resistor | 330 ohms |
| R10 | Resistor | 330 ohms |
| R11 | Resistor | 330 ohms |
| R12 | Resistor | 330 ohms |
| R13 | Resistor | 330 ohms |
| S1 | Dip switch bank (6 single pole single throw switches) | |
| S2 | Dip switch bank (6 single pole single throw switches) | |
| U1 | Microcontroller | HT48300 |
| U2 | Voltage Detector | 8053ALR |
| U3 | RF Module | RWS-371 |
| XL1 | Oscillator | 4 MHz |
| Z1 | Thyristor Device | ZNR271 |
| ZD1 | Zener Diode | 5.1 V/1 W |

Figure 8:
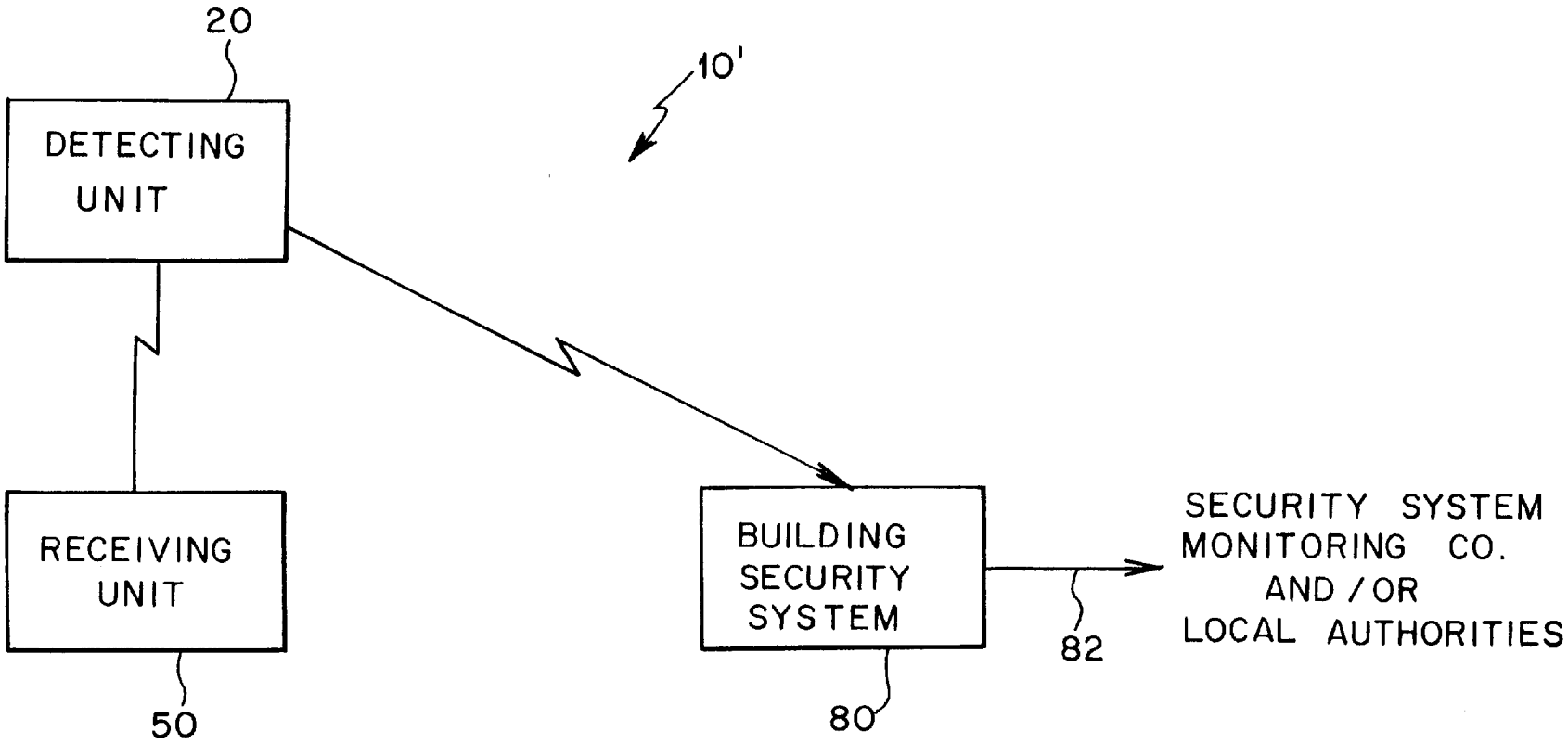
FIG. 8 is a block diagram of a system of the present invention functioning in cooperation with a building security system.

Referring now to FIG. 8, yet another embodiment of the present invention is shown wherein a system 10' is formed by at least one detecting unit 20, at least one receiving unit 50 and a building security system 80. In system 10', it is to be appreciated that the at least one detecting unit 20 transmits a hazardous condition alert signal to the building security system 80 in addition to the receiving unit 50 as described herein. It is also to be appreciated that the security system 80 may serve the primary purpose of alerting a security system monitoring company or local authorities of an intruder or other security condition over telephone line 82. However, the security system 80 also preferably includes receiving means similar to the at least one receiving unit 50 which receives the hazardous condition alert signal from the at least one detecting unit 20. The security system 80 may then communicate the existence of the hazardous condition within the building in which the system 10' is operating to the monitoring company and/or local authorities over line 82. In this manner, the present invention provides a passive system for detecting hazardous conditions and automatically reporting their existence to emergency personnel. It is to be understood that security system 80 may preferably be responsive to all detecting units 20 within a building whether or not the detecting units 20 cooperate with different receiving units 50.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A system for detecting the existence of a hazardous condition in an area, the system comprising:

at least one battery-powered detecting unit being located within the area for detecting the existence of the hazardous condition, the at least one battery-powered detecting unit generating and transmitting a battery status signal only if the battery power is at least equal to an acceptable level, thereby conserving battery power; and at least one receiving unit being responsive to the battery status signal such that the at least one receiving unit provides at least one sensory indication when the battery status signal is not received within a predetermined time period.

2. A system defined by claim 1 wherein the at least one battery-powered detecting unit periodically transmits the battery status signal.

3. A system defined by claim 1 further including a plurality of battery-powered detecting units respectively located within a plurality of zones within the area such that each detecting unit generates and transmits a battery status signal such that the at least one receiving unit responsively provides one of a plurality of sensory indications when one of the plurality of battery status signals is not respectively received.

4. A system defined by claim 1 wherein the at least one receiving unit provides a first sensory indication when the battery status signal is received and a second sensory indication when the battery status signal is not received.

5. A system as defined in claim 4 further comprising a first indicator mounted on the at least one receiving unit for providing the first sensory indication and a second indicator mounted on the at least one receiving unit for providing the second sensory indication.

6. A system as defined in claim 5 wherein the first and second indicators are light emitting diodes.

7. A system as defined in claim 6 wherein the first and second light emitting diodes are each a different color.

8. A system as defined in claim 1 wherein the at least one sensory indication provided by the at least one receiving unit also provides indication that the existence of the hazardous condition has been detected by the at least one detecting unit.

9. A system as defined in claim 8 wherein the at least one sensory indication is provided by a visual indicator.

10. A system as defined in claim 1 wherein the at least one receiving unit further includes at least one alert signal sensory indication to indicate that the existence of the hazardous condition has been detected by the at least one detecting unit.

11. A system as defined in claim 10 wherein the second sensory indication is provided by an audible indicator.

12. A system as defined in claim 11 wherein the at least one receiving unit further includes means for silencing the audible indicator.

13. A system as defined in claim 1 wherein the at least one receiving unit further includes a light source, operatively connected to the at least one receiving unit, for illuminating an area in a vicinity of the at least one receiving unit.

14. A system as defined in claim 1 wherein the at least one receiving unit further includes a power source adapted to be driven via power from an AC power outlet.

15. A system as defined in claim 1 wherein the at least one receiving unit further includes a rechargeable battery for providing a source of power to the unit.

16. A system as defined in claim 15 wherein the at least one receiving unit further includes a light source, operatively connected to the at least one receiving unit, for permitting the at least one receiving unit to be used as a portable illumination device.

17. A system as defined in claim 1 wherein the at least one detecting unit further includes a radio frequency transmitter circuit for transmitting the battery status signal.

18. A system as defined in claim 17 wherein the at least one receiving unit further includes a radio frequency receiver circuit for receiving the battery status signal.

19. A system for detecting the existence of a hazardous condition in an area, the system comprising:

a plurality of battery-powered detecting units, each detecting unit being respectively located within a plurality of zones within the area, each detecting unit including:

a sensing circuit, the sensing circuit sensing the existence of the hazardous condition within the respective zone and generating a hazardous condition alert signal in response thereto;

a battery level monitoring circuit, the battery level monitoring circuit monitoring the level of the battery powering the detecting unit and generating a battery status signal only when the battery power is at least equal to an acceptable level; and a transmitting circuit, the transmitting circuit transmitting at least one of the hazardous condition alert signal and the battery status signal; and at least one receiving unit, the at least one receiving unit being responsive to the plurality of detecting units and including:

a receiving circuit, the receiving circuit receiving one of the plurality of hazardous condition alert signals and the plurality of battery status signals;

a battery status indicating circuit, the battery status indicating circuit being responsive to the plurality of battery status signals, the battery status indicating circuit including a plurality of visual indicators which are respectively responsive to the plurality of battery status signals such that each indicator provides a first visual indication when the respective battery status signal corresponding thereto is received and a second visual indication when the respective battery status signal is not received within a predetermined time period; and a hazardous condition alert circuit, the alert circuit being responsive to the plurality of hazardous condition alert signals such that the alert circuit respectively activates the visual indicators corresponding to one of the detecting units when an alert signal is received therefrom.

20. A system as defined in claim 19 wherein the at least one receiving unit further includes at least one audible indicator which provides an audible indication in response to the plurality of alert signals received by the at least one receiving unit.

21. A system as defined in claim 20 wherein a unique audible indication is provided by the at least one audible indicator for each one of the plurality of alert signals.

22. The system as defined in claim 20 wherein the at least one receiving unit further includes means for silencing the at least one audible indicator.

23. A system as defined in claim 19 wherein each of the plurality of battery status signals is transmitted periodically.

24. A system as defined in claim 19 wherein the battery status indicating circuit further includes a plurality of pairs of visual indicators whereby each pair includes a first indicator for providing the first visual indication and a second indicator for providing the second visual indication.

25. A system as defined in claim 24 wherein the first and second indicators are a different color.

26. A system as defined in claim 25 wherein the first and second indicators are light emitting diodes.

27. A system as defined in claim 19 wherein the at least one receiving unit further includes a light source, operatively connected to the at least one receiving unit, for illuminating an area in a vicinity of the at least one receiving unit.

28. A system as defined in claim 19 wherein the at least one receiving unit further includes a power source adapted to be driven via power from an AC power outlet.

29. A system as defined in claim 19 wherein the at least one receiving unit further includes a rechargeable battery for providing a source of power to the unit.

30. A system as defined in claim 29 wherein the at least one receiving unit further includes a light source, operatively connected to the at least one receiving unit, for permitting the at least one receiving unit to be used as a portable illumination device.

31. A system as defined in claim 19 wherein the transmitting circuit of each of the plurality of detecting units includes means for uniquely encoding one of the hazardous condition alert signal and the battery status signal in order to uniquely identify the signal.

32. A system as defined in claim 31 wherein the receiving circuit further includes means for decoding one of each of the battery status signals and the hazardous condition alert signals to determine which one of the plurality of detecting units transmitted the signal received.

33. A method for monitoring a voltage level associated with a battery of a battery-powered detecting unit, the detecting unit detecting the existence of a hazardous condition in an area, the method comprising the steps of:

generating a battery status signal only when the battery in the detecting unit is at least equal to an acceptable level;

transmitting the battery status signal from the detecting unit only when the battery in the detecting unit is at least equal to the acceptable level, thereby conserving battery power;

monitoring the battery status signal at a receiving unit, the receiving unit including a sensory indicator; and activating the sensory indicator when the battery status signal is not received by the receiving unit within a predetermined time period.

34. A method as defined in claim 33, further including the steps of:

generating a hazardous condition alert signal when the existence of the hazardous condition is detected by the detecting unit;

transmitting the alert signal from the detecting unit;

monitoring the alert signal at a receiving unit; and activating the sensory indicator when the hazardous condition alert signal is received.

* * * * *